United States Patent [19]

Zamacola

[11] Patent Number: 4,642,927

[45] Date of Patent: Feb. 17, 1987

[54] SELECTOR DEVICE FOR FIREARMS

[75] Inventor: Eduardo I. Zamacola, Elgoibar, Spain

[73] Assignee: Laurona Armas, S.A., Eibar, Spain

[21] Appl. No.: 806,093

[22] Filed: Dec. 6, 1985

[30] Foreign Application Priority Data

Dec. 19, 1984 [ES] Spain ..... 538838

[51] Int. Cl.[4] ..... F41C 7/00

[52] U.S. Cl. ..... 42/42.01

[58] Field of Search ..... 42/42.01, 70.01, 70.04, 42/70.05, 70.08, 42.02

[56] References Cited

U.S. PATENT DOCUMENTS

| | | | |
|---|---|---|---|
| 383,814 | 5/1888 | Jolly | 42/42.01 |
| 859,845 | 7/1907 | Sawtell | 42/42.01 |
| 1,035,148 | 8/1912 | Bishop | 42/42.01 |
| 3,389,488 | 6/1968 | Beretta | 42/42.01 |
| 4,545,143 | 10/1985 | Schultz | 42/42.01 |

*Primary Examiner*—Deborah L. Kyle
*Assistant Examiner*—Michael J. Carone
*Attorney, Agent, or Firm*—Neuman, Williams, Anderson & Olson

[57] ABSTRACT

An improved selector device is provided for controlling the locking and striker mechanisms of a firearm. This device includes a movable button selector and a shaft rotatably mounted in said firearm in sliding engagement with the button selector. The shaft includes a base gudgeon which guides the selector in one direction as the selector slides over it. The shaft guides the button selector along a second direction and allows the selector to move in the second direction, which is substantially perpendicular to the first, by rotating as the button selector pushes the base gudgeon in the second direction.

8 Claims, 5 Drawing Figures

SELECTOR DEVICE FOR FIREARMS

BACKGROUND OF THE INVENTION

1. Field of the Invention

The present invention relates to an improved control mechanism for firearms and more specifically to a simplified control mechanism for selecting the firing pin of a multi-pin firearm and for locking the firearm.

2. Description of the Prior Art

Firearms, particularly two-barrel firearms such as shotguns, have control devices which allow the user to release both strikers or firing pins in succession by means of a single trigger. In using such devices, the operator or user can freely determine which of the two firing pins strike first upon pressing the trigger. A selecting mechanism provided with a control that the user can set from outside the firearm allows the operator to make such a selection.

One known method of carrying out this operation is to integrate the firing pin selecting function into the locking mechanism of the firearm. Thus, in addition to the usual movement of the mechanism's locking button in a longitudinal direction and the two positions representing the "lock" or "fire" mode, the button moves in the transverse direction to select the first or second firing pin of the firearm.

In this known mechanism, the opening through which the button of the firearm's lock protrudes has a transverse dimension which allows the required transverse displacement of the button to effect the control function. However, the increased width prevents proper control of the movement of the lock-button to ensure safe, easy, and comfortable handling and to prevent any involuntary movements.

In the past, the installation of moving collars of various designs has lessened this inconvenience. However, these collars do not allow the button to freely move in the desired path. They introduce friction between the firearm's housing and the locking/selecting mechanism which results in a higher risk of obstruction and improper alignment.

The selector device of the present invention provides a mechanism which ensures proper control of the locking and firing pin selection button of a firearm. It allows the user of the firearm to easily and consistently make the proper selection in locking and firing the firearm. It produces the requisite mechanical action to safely, consistently and comfortably effect these functions.

SUMMARY OF THE INVENTION

It is an object of this invention to provide an improved control device for a firearm.

It is another object of the present invention to provide a control device which is extraordinarily simple and which provides great working safety.

It is yet another object of this invention to provide a control device for a firearm which a user can operate from the outside of the firearm and which controls both locking and firing pin selecting functions.

It is a further object of the present invention to provide a control device to guide a button selector and maintain it in proper alignment in its longitudinal and transverse movements.

Other objects, advantages and features of the present invention become apparent upon reading the following detailed description and appended claims, and upon reference to the accompanying drawings.

The foregoing objects and advantages of the present invention are achieved through the provision of a control mechanism having a button selector connected to a shaft disposed inside a firearm. The upper section of the button projects outside the housing of the firearm through an opening in the housing. The lower section of the button lies inside the firearm housing, below the opening. This lower section generally has an inverted Y or forklike cross-section with a bifurcated open bottom for receiving the shaft.

The shaft has at least one connecting segment and at least two gudgeons, one of which serves as a sliding base for the button selector and the other which serves as a rotating axle for the shaft. An opening such as a drill hole in the firearm housing or the housing for the locking and selecting mechanism receives the axle gudgeon and serves as a bearing in which this gudgeon rotates. The base gudgeon extends below the opening for the lock button, substantially parallel to the first gudgeon, supports the button and defines the button's longitudinal path. The lower section of the button receives the base gudgeon for sliding engagement with it. The button moves over the base gudgeon between two points, one representing the "lock" position of the firearms safety lock and the other the "fire" position of the lock.

The longitudinal axis of the axle gudgeon housed in the drill hole lies on the longitudinal and vertical median plane of the opening in the firearm housing. When the operator of the firearm displaces the button transversely of the base gudgeon, the bifurcated lower section of the button forces the base gudgeon to move with it. In response to this force, the shaft rotates about an axis defined by the longitudinal axis of the axle gudgeon in the drill hole opening and guides the button selector by allowing it to only move transversely of the base gudgeon. The radius of rotation of the base gudgeon is equal to the distance between it and the axle gudgeon.

To provide distinct end settings for the button selector in the transverse direction which correspond to engagement of the first and second firing pins, the mechanism of the present invention includes a ball and spring assembly. An appropriately disposed enclosure contains the ball and spring assembly and allows the ball to engage the shaft. The assembly retains the shaft at the ends of its stroke by obstructing the movement of the shaft at the middle portion of the stroke. To move the button and base gudgeon from one setting to the other, the user must provide enough force to overcome the driving force that the spring applies to the ball.

A leaf spring having a raised portion which serves as an obstruction for a pin connected to the button selector provides a similar function as the one provided by the spring and ball assembly. It retains the button at either one of the two opposite ends of the opening in the longitudinal direction.

During the displacements of the button and shaft, the bifurcated lower section of the button continuously engages the base gudgeon of the shaft. When the user moves the button longitudinally of the opening the lower section slides over the base gudgeon. When the user moves the button transversely of the opening, the lower section pivotally engages the base gudgeon. For both longitudinal and transverse movement of the button selector, the walls of the opening in the housing of the firearm serve as stops to define the limits of the paths of the button selector.

BRIEF DESCRIPTION OF THE DRAWINGS

For a more complete understanding of this invention one should now refer to the four embodiments illustrated in greater detail in the accompanying drawings and described below by way of examples of the invention. In the drawings.

While the invention is described in connection with four embodiments, it will be understood that the invention is not limited to these embodiments. Furthermore, it should be understood that the drawings are not to scale and the embodiments are illustrated in part by graphic symbols, diagrammatic representations and fragmentary views. In certain instances, details may have been omitted which are not necessary for an understanding of the present invention.

DETAILED DESCRIPTION OF THE DRAWINGS AND PREFERRED EMBODIMENTS

Figure 1:
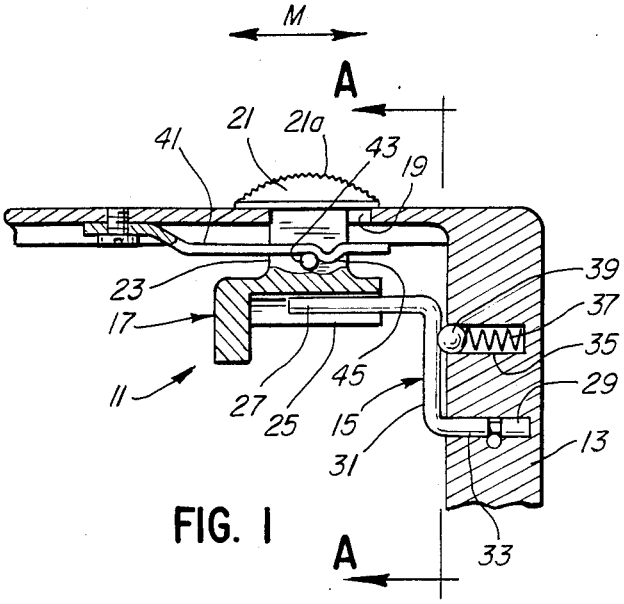
FIG. 1 is a sectional side elevation view of one embodiment of a control mechanism embodying the present invention.

Turning now to the drawings, FIG. 1 shows, at 11, the first preferred embodiment of a control mechanism of the present invention disposed in the housing 13 of a firearm. The control mechanism generally comprises a shaft 15 with a crank-type configuration and a button selector 17 mounted on the shaft.

The housing 13 has an opening 19 through which the top portion of the button selector 17 protrudes. To allow movement to the button selector 17 in the longitudinal M and transverse N (see FIG. 2) directions, this opening 19 has suitable longituidnal transverse dimensions.

The button selector 17 includes a top cap portion 21 which overlies and covers the opening 19 to prevent harmful substances from entering the firearm housing. The top surface 21*a* of the cap 21 includes roughened portion which provides resistance to sliding. This portion allows the user or operator to easily move the button selector 17 with his or her thumb or finger without producing involuntary movements and undesirable selections.

The button selector 17 also includes a stem portion 23 which extends through the opening 19 between the cap portion 21 and a lower base portion 25. The base portion 25 lies in the firearm housing and has an inverted Y or fork-like cross-section with a bifurcated open bottom which receives an end or base gudgeon 27 of the shaft 15. At the bifurcated bottom, the base portion 25 maintains constant engagement with the base gudgeon 27. Suitable known connecting devices (not shown) connect the button selector 17 to the firearm's striker mechanism and to the locking mechanism (known and not shown). These known devices transmit the movements of the button selector 17 to the striker and lock mechanism to activate these mechanisms.

As stated above, the shaft 15 has a crank-like configuration and a round cross-section. It is an integral member with three segments—the base gudgeon 27, an axle gudgeon 29, and a middle connecting segment 31. The longitudinal axes of these three segments lie on the same plane, with the longitudinal axes of the base gudgeon 27 and the axle gudgeon 29 lying substantially parallel to each other and substantially perpendicular to the longitudinal axis of the connecting segment 31.

An opening such as a drill hole 33 in the firearm housing 13 receives the axle gudgeon 29 and acts as a bearing for this gudgeon. When the user moves the button selector 17 in the transverse direction, the selector pulls the base gudgeon 27 with it, forcing the shaft 15 to rotate about the longitudinal axis of the axle gudgeon 29. The base gudgeon 27 moves along an arc, and its radius of rotation has a length equal to the length of the connecting segment 31 or the distance between the base and axle gudgeons. During this rotation, the shaft 15 guides the button selector in its movement in the transverse direction.

The longitudinal axis of the drill hole 33 lies on a vertical and longitudinal plane which bisects the opening 19. Above the drill hole 33, the longitudinal axis of a second drill hole 35 lies on this median plane. The second drill hole 35 contains a spring 37 and ball 39 which maintains the button selector 17 at the end points of its transverse movement and provides distinct and stable end settings for the selector button in the transverse direction.

As the shaft 15 rotates, its connecting segment 31 moves parallel to the vertical portion of the housing 13 which includes the two drill holes 33 and 35. It moves adjacent the surface of the housing 13, and over the drill hole 35. As the connecting segment 31 moves over the drill hole 35, the ball 39 engages the connecting segment and obstructs its movement from one traverse end setting to the other.

To move the button selector 17 from one end setting to the other, the user applies sufficient force to overcome the force of the spring 37 which pushes the ball 39 against the connecting segment 31. The stroke of the connecting segment 31 is small and does not extend past the drill hole 35 so that the ball 39 constantly contacts the connecting segment along the periphery of the round shaft. Midway through this stroke, at the median plane, when the radius of the ball 39 is co-linear with the radius of the shaft 15, the shaft pushes the ball 39 the greatest distance into the drill hole 35. At this point, the spring 37 applies the most force against the ball 39 and the shaft 15.

The base gudgeon 27 functions as a rail to guide the button selector 17 in the longitudinal direction. It maintains continuous engagement with the base portion 25 of the button selector 17 and guides it during its reciprocating movement in the longitudinal direction. During transverse movements of the button selector, the base gudgeon 27 pivots in the open bottom of the base portion 25 of the button selector.

To provide distinct and stable end setting for the button selector 17 in the longitudinal direction, the control mechanism of the present invention includes a leaf spring 41 mounted to the housing 13 and a pin 43 mounted to the stem portion 23 of the bottom selector 17. The spring 41 coacts with the pin 43 to restrict the movement of the button selector 17. A bend 45 in the spring 41 serves as an obstruction for the pin 43 and the selector as the user moves the selector from its end settings. The user provides sufficient force to allow the pin 43 to move the spring 41 upward and to override the bend 45 in the spring.

The sidewalls of the opening 19 serve as stops for the button selector 17. They define the limits of the selectors longitudinal and transverse strokes.

Figure 2:
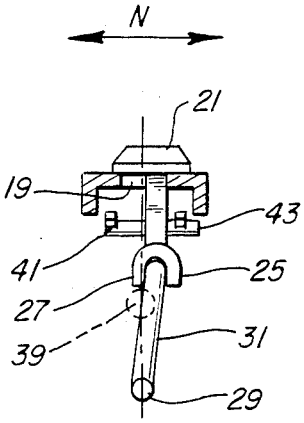
FIG. 2 is a sectional view taken along line A—A in FIG. 1.

In operation, the user of the firearm moves the button selector by placing his or her thumb or finger on the top surface 21*a* of the selector's cap 21 and applying pressure in the longitudinal or transverse direction. The shaft 15 allows movement only in these two directions as described above. FIGS. 1 and 2 show the selector 17 in the "lock" position. In this position the button selector 17 actuates the lock mechanism so that the firearm cannot fire or discharge. To change this setting to the "fire" position, the user must move the button selector longitudinally to the right (see FIG. 1), applying sufficient force to overcome the force of the spring 41. FIG. 2 shows the selector 17 at the right edge of the opening 19. In this position, the button selector 17 actuates the striker mechanism so that the firearm uses one of the strikers or firing pins. To engage the other striker, the user moves the button selector transversely to the left (see FIG. 2), applying sufficient force to overcome the force of the spring 37.

Figure 3:
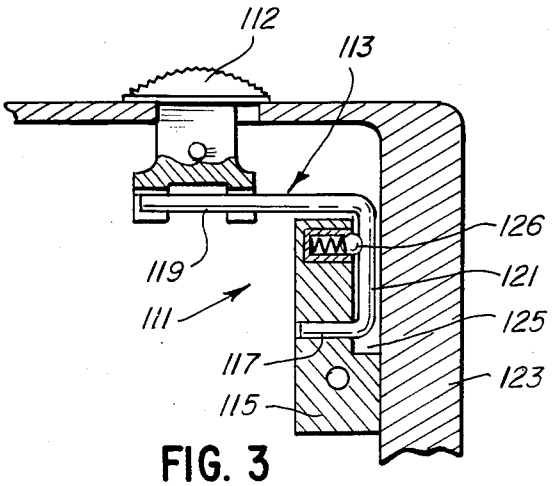
FIG. 3 is a sectional view showing a second embodiment of the present invention.
Figure 4:
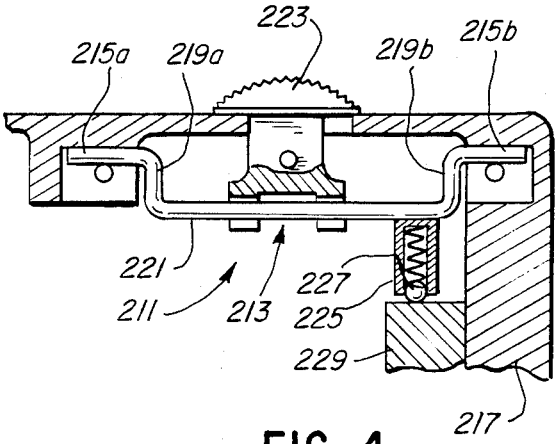
FIG. 4 is a sectional view showing a third embodiment of the present invention.
Figure 5:
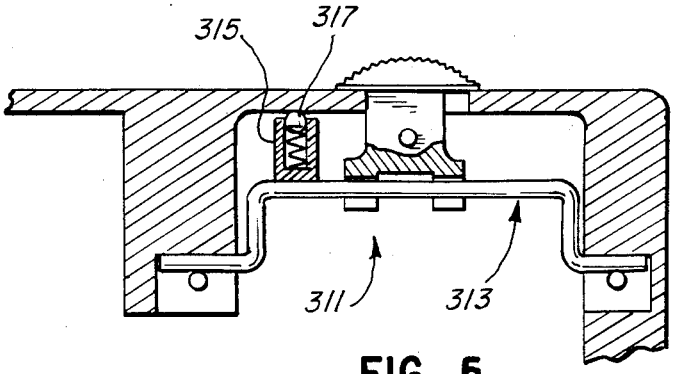
FIG. 5 is a sectional view showing a fourth embodiment of the present invention.

FIGS. 3 through 5 illustrate alternative embodiments of the control mechanism of the present invention, although many of the components and elements of these alternative embodiments are identical to those described and illustrated in FIGS. 1 and 2. FIG. 3 shows the first alternative embodiment of the present invention at 111. This embodiment includes a button selector 112, a shaft 113 having a J-like configuration and a structural support member 115.

Like the shaft of the embodiment shown in FIGS. 1 and 2, the shaft 113 has three segments—an axle gudgeon 117, a base gudgeon 119, and a connecting segment 121. The longitudinal axes of these three segments lie on the same plane, and the longitudinal axes of the axle and base gudgeons are substantially parallel to each other and substantially perpendicular to the longitudinal axis of the connecting segment 121. Unlike the shaft of the embodiment shown in FIGS. 1 and 2, the axle gudgeon 117 extends in the same direction as the base gudgeon 119.

In addition to a different shaft configuration, the first alternative embodiment differs from the embodiment described above in that it uses the support member 115 to mount the shaft 113 to the firearm housing 123. The support member 115 forms an extension of the firearm housing 123 and defines a narrow opening 125 between itself and the housing 123. This member 115 has the shaft's axle gudgeon 117 journaled into it. It also houses a spring and ball assembly 126 which provides distinct end settings for the button selector 112 in the transverse direction. A leaf spring and pin assembly (not shown) provides a similar function in the longitudinal direction. As the shaft rotates, its connecting segment 121 moves in the opening 125 between the support member 115 and the firearm housing 123.

In operation, the base gudgeon 119 functions as a rail to guide the button selector 112 longitudinally of the base gudgeon. To guide the button selector 112 transversely of the base gudgeon 119 (in a direction into and out of the paper), the shaft 113 rotates about axle gudgeon 117.

FIG. 4 shows the second alternative embodiment of the control mechanism of the present invention at 211. The shaft 213 of this embodiment has a channel-shaped configuration with axle gudgeons 215*a* and 215*b* journaled into the firearm's housing 217. In addition, the shaft 213 includes connecting segments 219*a* and 219*b* and a base gudgeon 221. Axial gudgeons 215*a* and 215*b* are parallel to base gudgeon 221 and perpendicular to connecting segments 219*a* and 219*b* which connect the axle gudgeons and base gudgeon together. The control mechanism's button selector 223 rides on the base gudgeon 221 which serves as a rail to guide the selector longitudinally of the base gudgeon. To guide the selector transversely of the base gudgeon 221 (in a direction into and out of the paper), the shaft 213 rotates about its axle gudgeons 215*a* and 215*b*.

A leaf spring and pin assembly (not shown) provides distinct end settings for the button selector 223 in the longitudinal direction. To provide distinct end settings in the transverse direction, the control mechanism includes an enclosure 225 which houses a spring and ball assembly 227 and has an open bottom to allow the ball to move in and out. Appropriate connecting devices connect this enclosure to the shaft 213 and place it in a position where the ball bears on the housing section 229. When the shaft reaches the midway point of its stroke, it places the open top of the enclosure at the shortest distance to the housing section 229. At this point, the ball compresses the spring more than at any other point along the stroke and the spring provides the greatest force to restrain the movement of the shaft 213.

The third alternative embodiment of the control mechanism of the present invention, shown in FIG. 5, at 311, is similar to the second alternative embodiment. It includes a shaft 313 having an inverted channel configuration and an enclosure 315 for the spring and ball assembly 317 which bears against a different portion of the firearm housing 319.

While the above disclosure has provided only four embodiments of the invention, one should understand, of course, that the invention is not limited to these embodiments since those skilled in the art may make modifications and other embodiments, particularly upon considering the foregoing teachings. For example, the connecting segments of the shaft used in the control mechanism of the present invention may be inclined, rather than perpendicular, with respect to the base and axle gudgeons. In addition, the longitudinal axis of the axle gudgeon may lie outside the longitudinal, vertical plane which bisects the opening through which the button selector extends. It is, therefore, contemplated by the appended claims to cover any such modifications and other embodiments as incorporate the essential features of this invention within the true spirit and scope of the following claims.

What is claimed is:

1. A selector device for controlling the locking and striker mechanisms of a firearm, said selector device comprising: a button selector which is movable along a first path for activating the locking mechanism of said firearm and movable along a second path for activating the striker mechanism of said firearm; and a shaft rotatably mounted to said firearm for guiding said button selector along said first and second paths, said shaft including at least one axle gudgeon for journaling said shaft to said firearms, a base gudgeon in sliding engagement with said button selector for guiding said selector in one direction longitudinally of said base gudgeon along said first path and in a second direction transversely of said base gudgeon along said second path, and at least one connecting segment joining said axle and base gudgeon and spacing apart said axle and base gudgeons a predetermined distance, whereby movement of said button selector transversely of said base gudgeon forces said base gudgeon to rotate about said axle gudgeon and guide said selector along said second path.

2. The selector device in claim 1, further comprising end setting means for maintaining said button selector at the ends of the two paths of said button selector, said ends of said first path corresponding to the lock and unlock settings for said locking mechanism and said ends of said second path corresponding to the first and second striker settings for said striker mechanism.

3. A selector device as in claim 1, wherein said shaft includes one axle gudgeon, and one connecting segment which combine with said base gudgeon to form a shaft with a crank-like configuration.

4. A selector device as in claim 1, wherein said shaft includes two axle gudgeons substantially parallel to said base gudgeon, and two connecting segments disposed substantially perpendicular to said axle and base gudgeons for joining said axle and base gudgeons.

5. A selector device as in claim 1, wherein said firearm includes a housing for containing said button selector and said shaft, said housing defining an opening and said button selector having a portion thereof projecting through said opening to the outside of said housing.

6. A selector device as in claims 1, 2, 3, 4 or 5 wherein said shaft is an integral member.

7. A selector device as in claims 1, 2, 3, 4 or 5 wherein said button selector has a bifurcated, open lower portion for receiving said base gudgeon.

8. A selector device for controlling the locking and striker mechanisms of a firearm, said selector device comprising: a button selector which is movable along a first path for activating the locking mechanism of said firearm and movable along a second path for activating the striker mechanism of said firearm; and a shaft rotatably mounted to said firearm for guiding said button selector along said first and second paths, said shaft including at least one axle gudgeon for journaling said shaft to said firearm, a base gudgeon disposed substantially parallel to said axial gudgeon in sliding engagement with said button selector for guiding said selector in one direction longitudinally of said base gudgeon along said first path and in a second direction transversely of said base gudgeon along said second path, and at least one connecting segment disposed substantially perpendicular to said axle and base gudgeons and joining said axle and base gudgeon and spacing apart said axle and base gudgeons a predetermined distance, whereby movement of said button selector transversely of said base gudgeon forces said base gudgeon to rotate about said axle gudgeon and guide said selector along said second path.

* * * * *